US009016373B2

(12) United States Patent
VanDelden

(10) Patent No.: US 9,016,373 B2
(45) Date of Patent: Apr. 28, 2015

(54) MAGNETORHEOLOGICAL BLOWOUT PREVENTER

(76) Inventor: Jay VanDelden, Trumansburg, NY (US)

( * ) Notice: Subject to any disclaimer, the term of this patent is extended or adjusted under 35 U.S.C. 154(b) by 783 days.

(21) Appl. No.: 13/153,571

(22) Filed: Jun. 6, 2011

(65) Prior Publication Data

US 2011/0297394 A1 Dec. 8, 2011

Related U.S. Application Data

(60) Provisional application No. 61/396,922, filed on Jun. 5, 2010.

(51) Int. Cl.
*E21B 33/06* (2006.01)
*H01F 1/44* (2006.01)
*H01F 1/00* (2006.01)

(52) U.S. Cl.
CPC ..... *E21B 33/06* (2013.01); *H01F 1/447* (2013.01); *H01F 1/0009* (2013.01)

(58) Field of Classification Search
USPC ..... 166/292, 305.1, 66.5, 85.4; 507/271; 251/1.1, 1.2; 137/315.02
See application file for complete search history.

(56) References Cited

U.S. PATENT DOCUMENTS

| | | | | |
|---|---|---|---|---|
| 2,609,836 | A | 9/1952 | Knox | |
| 4,436,313 | A | 3/1984 | Tamama | |
| 4,834,898 | A * | 5/1989 | Hwang | 252/62.56 |
| 6,280,658 | B1 * | 8/2001 | Atarashi et al. | 252/572 |
| 7,021,406 | B2 | 4/2006 | Zitha | |
| 7,032,670 | B2 | 4/2006 | Zitha | |
| 7,300,033 | B1 | 11/2007 | Whitby | |
| 7,428,922 | B2 * | 9/2008 | Fripp et al. | 166/66.5 |
| 7,533,865 | B2 | 5/2009 | Whitby | |
| 2010/0243240 | A1 * | 9/2010 | Blange | 166/248 |
| 2011/0272143 | A1 * | 11/2011 | Al-Tahini | 166/250.01 |
| 2014/0332203 | A1 * | 11/2014 | Meinke et al. | 166/75.15 |

OTHER PUBLICATIONS

Rosensweig,; Magnetic Fluids; Annual Reviews Fluid Mechanics 19 (1987) 437-63, Cornell University.
Bitter, F,; Water Cooled Magnets; The Review of Scientific Instruments vol. 33 No. 3 (1961), 342-49, Massachusetts Institute of Technology.
Genc, S et al,; Rheological Properties of Magnetorheological Fluids; Institute of Physics Publishing Smart Mater. Struct. 11 (2002) 140-146, University of Pittsburg.
Jiles, D.C. et al,; Recent Advances and Future directions in magnetic materials; Acta Materialia 51 (2003) 5907-5939, Elsevier.
Jolly, M. et al,; Properties and Applications of Commercial Magnetorheological Fluids; Journal of Intelligent Material Systems and Structures Jan. 1999 vol. 10 No. 1, 5-13.
Klingenberg, D. et al,; Making Fluids into Solids with Magnets; Scientific America Oct. 1993. 112-3.

(Continued)

*Primary Examiner* — Kenneth L Thompson
*Assistant Examiner* — Catherine Loikith
(74) *Attorney, Agent, or Firm* — William Greener; Bond, Schoeneck & King, PLLC

(57) ABSTRACT

A Blowout Preventer comprising a housing, one or more magnets and a magnetic fluid is described. More particularly, a Magnetorheological Blowout Preventer with a Magnetorheological Ram Head that conforms to virtually any cross sectional shape is described with ultra-reliable termination of natural gas and/or oil effluent flow resulting.

13 Claims, 6 Drawing Sheets

(56) References Cited

OTHER PUBLICATIONS

Lee, J. et al,; Use of Magnetic Nanoparticles for Smart Drilling Fluids. American Association of Drilling Engineers Paper (2009) 1-5.
Popplewell, J. et al,; Magnetorheological fluid composites. J. Phys D. Appl. Phys. 29 (1996) 2297-2303.
Lord MR Fluid Demonstration Device. Pamphlet. Lord Corporation (Rev. 1) Feb. 2006.
Wang, J. et al,; Magnetorheological fluid devices; principles, characteristics and applications in mechanical engineering. Proc Instn Mech Engrs vol. 215 Part 1 (2001).
Zitha. et al,; Fluid Flow Control Using Magnetorheological Fluids. Society of Petroleum Engineers Inc. (2002).
Whitby, M. Design Evolution of a Subsea BOP: Blowout Preventer Requirements Get Tougher as Drilling Goes Ever Deeper. Drilling Contractor. May/Jun. 2007. 36-8.
Tadamor, R. et al,; Resolving the Puzzle of Ferrofluid Dispersants. Department of Materials and Interfaces. Weizman Institute of Science. Langmuir 2006 vol. 16 9117-9120.
Popplewell, J. et al,; Magnetorheology of Ferrofluid Composites. Journal of Magnetism and Magnetic Materials 149 (1995) 53-6.
Raj, K. et al,; Advances in Ferrofluid Technology; Journal of Magnetism and Magnetic Materials 149 (1995) 174-180.

* cited by examiner

MAGNETORHEOLOGICAL BLOWOUT PREVENTER

RELATED APPLICATION

The present application claims priority to U.S. provisional patent application No. 61/396,922, filed on Jun. 5, 2010; all of the foregoing patent-related document(s) are hereby incorporated by reference herein in their respective entirety(ies).

BACKGROUND OF THE INVENTION

1. Field of the Invention

In the field of oil and/or natural gas drilling, wellbores and wellbore conduits (see DEFINITIONS section) are known. The present invention relates generally to blowout preventers, and more particularly to a magnetically-controlled blowout preventer that employs a magnetic fluid in any of its construction and one or more magnets to control the flow of petroleum and/or natural gas effluent from an oil well.

2. Description of the Related Art

A Blowout Preventer (or BOP as it is sometimes called) is essentially a large valve used to seal off an oil or natural gas well. Sometimes, while drilling these wells, there are unexpected surges of underground pressure. These surges or "kicks" can force oil and/or natural gas into the wellbore uncontrollably. When this happens, it is customary to engage a Blowout Preventer which prevents the oil and/or natural gas from escaping into the environment.

Over the years, considerable progress has been made in the design, development, fabrication and deployment of Blowout Preventers. They are currently manufactured by several companies including: Cameron International (Houston, Tex.), Hydril Pressure Control (aka GE Oil & Gas of Houston, Tex.) and Shaffer (aka National Oilwell Varco of Houston, Tex.) among others.

There are two basic types of Blowout Preventers: the Annular type and the Ram type. In the Annular Blowout Preventer, one or more wedge-faced hydraulic pistons push against a doughnut-shaped elastomeric packing unit that squeezes against the drill pipe and BOP housing thereby sealing off the well. In the Ram Blowout Preventer, opposing steel plungers (also known as rams) are hydraulically forced together in the middle of the BOP housing thereby reducing flow. As a safety precaution, two or more blowout preventers are often combined into a stack to insure that the well can be sealed off in an emergency.

Blowout Preventers are quantitatively characterized by a number of different parameters such as their: pressure capacity, weight, design (annular versus ram), hydraulic requirements, electrical requirements, control system requirements (both electrical and acoustic), temperature requirements, riser interface, support frame(s), diagnostic systems, footprint, remote vehicle intervention compatibility and any number of other properties relating to how it is to be implemented (for example, lubrication, mud compatibility, salt-water compatibility, etc)

Over the years, engineers have strived to maintain mechanical simplicity in the design of Blowout Preventers in hopes of achieving ultra-high reliability as a fail-safe device. However, as natural resources become more scarce and drilling environments become more hostile and remote, control systems and necessary infrastructure become far more complex, thereby increasing the overall probability of an unforeseen event with potentially-catastrophic consequences. A particularly poignant example of this is the 2010 Macondo Well (aka Deepwater Horizon) Disaster in the Gulf of Mexico.

In U.S. Pat. No. 4,436,313 ("Tamama"), Tamama utilizes a Ferrofluid for sealing off a propeller shaft (on a ship) against the invasion of sea water. In his invention, 100 Å magnetite particles dispersed within a base liquid with surface-active agents was used in conjunction with longitudinally-spaced, annular, iron pole blocks and circularly-spaced permanent magnets fixed there between. Fundamental to Tamama's work is the necessity of the ferrofluid seal to remain in the liquid state in the presence of a magnetic field, so that the propeller shaft can rotate freely with little friction. However, in the case of a magnetorheological fluid, the seal would congeal into a solid plug in the presence of a magnetic field thereby prohibiting rotation of the propeller. And, while Tamama uses a form of magnetic fluid for sealing a propeller shaft of a sea vessel, he does not disclose the use of a magnetic fluid for sealing off a fluid conduit (such as an oil pipe).

In U.S. Pat. No. 7,021,406 ("406 Zitha"), 406 Zitha describes certain ways to use magnetorheological fluid for petroleum exploration. In his method, 406 Zitha employs an electromagnet at the bottom of the drill string (just above the drill head) to change the viscosity of magnetorheological drilling fluid for reducing the effects of water dilution and leak off from fractures in the stratum. However, nowhere does 406 Zitha disclose the use of a magnetic fluid for blowout prevention. 406 Zitha's bottom-up approach is fundamentally flawed for such purposes because it does nothing to protect against a blowout that might occur at any point above the electromagnet as a result of wellbore destabilization. In comparison, the Magnetorheological Blowout Preventer according to the present invention is a top-down approach (i.e. implemented at the top of the wellbore (in the casing or riser)) and thus serves to protect the entire length of the well against a blowout.

Other difficulties arise in 406 Zitha's approach when applied to preventing the flow of oil and/or natural gas along a wellbore. For example, in 406 Zitha, the electromagnet is located at the bottom of the wellbore, many thousands of feet into the earth where high-current electricity is nearly impossible to provide.

Another inconsistency in 406 Zitha's approach is that the electromagnet at the bottom of the drill string (just above the drill head) would have its strongest magnetic field in the hollow-center core through which the magnetorheological drilling fluid must pass. And thus, the same magnetic field to be used for mitigating the effects of dilution and leak off outside the drill string (that is, in the stratum where the strength of the magnetic field is weakest) would necessarily impose a tremendous burden of increased pressure for the mud pumps to overcome. All things considered, 406 Zitha's approach is not a viable option for reliably sealing off the full extent of an oil well in the event of a blowout.

The following published documents may also include helpful background information: (i) U.S. Pat. No. 2,609,836 ("Knox"); (ii) U.S. Pat. No. 7,300,033 ("033 Whitby"); (iii) U.S. Pat. No. 7,533,865 ("865 Whitby"); (iv) U.S. Pat. No. 7,032,670 ("670 Zitha"); and (v) pamphlet entitled "LORD MR Fluid demonstration Device" by LORD Corporation, dated 2006.

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention recognizes that there is a need for a paradigm shift in the design of a modern Blowout Preventer. The paradigm shift of the present invention involves the use of nano-engineered, magnetic fluids for achieving ultra-high reliability. More particularly, this paradigm shift of the present invention makes use of magnetorheological fluid and one or more electromagnets for stopping the flow of natural gas and/or petroleum effluent from a leaking well.

An important aspect of some embodiments of the present invention is the incorporation of a supply of magnetic fluid (defined herein) and/or magnetically pluggable fluid (see DEFINITIONS section) in the construction of oil drilling equipment (such as oil drilling exploration equipment). While most of this document will speak in terms of "magnetorheological fluid," it should be understood that the present invention is not necessarily so limited. Some embodiments of the present invention incorporate magnetorheological fluid and a magnet in the construction of a Magnetorheological Blowout Preventer for stemming the flow of petroleum oil and/or natural gas effluent with heretofore-unprecedented levels of reliability.

An aspect of the present invention relates to a Blowout Preventer and associated method directed to the use of magnetorheological fluid and one or more magnets. This method includes the use of a magnetically-controlled liquid and magnets (permanent magnets and/or electromagnets) for stemming the flow of natural gas and/or petroleum effluent from a well.

Some embodiments of the present invention may exhibit one or more of the following objects, features and/or advantages identified in the following enumerated list, but none of the items in this list should be interpreted as implicit claim limitations because of their presence on this list and/or because of the wording used in describing any of these potentially applicable objects, features and/or advantages:

1. A Magnetorheological Blowout Preventer according to the present invention when used with electromagnets requires fewer moving parts with reduced servicing needs and lower maintenance costs.

2. The Yield Stress of magnetorheological fluid in the magnetically-excited state is dependent on the magnitude of the applied magnetic field. And, in the case of an electromagnet, this magnetic field strength is related to the number of wire windings around the core and the electrical current passing through the wires. Because these are easily controlled, the Magnetorheological Blowout Preventer can be made adaptive with regard to how much pressure it is capable of holding back.

3. A Magnetorheological Blowout Preventer according to the present invention used in conjunction with magnetorheological drilling fluid could differentially and simultaneously control the viscosity of the drilling fluid in different transverse locations within the well-conduit. For example, inside the drill string the viscosity of the drilling fluid could be made purposefully very low, thereby facilitating its flow downward. Simultaneously however, outside the drill string the viscosity of this same drilling fluid could be made very large, thereby inhibiting its flow upward. Or vice versa. Such spatially-differential viscosity means could play an important role in next-generation mud pumping systems.

4. Magnetorheological fluids are comprised primarily of surfactant-coated, micrometer-sized iron particles suspended in a carrier liquid. As such, they can be manufactured from materials that are more or less benign to the local environment around the drilling rig (if ever they were to leak into that environment). This could result in substantially reduced clean-up costs.

5. In the event of catastrophic failure, should there be magnetorheological fluid escaping into the environment, it can be easily captured and recycled magnetically. By placing an electromagnet or permanent magnet near the breach, the magnetorheological fluid will be immediately attracted to it. In subsea applications, this will also help to reduce turbidity thereby facilitating remote viewing of the breach.

6. Certain aspects of a Magnetorheological Blowout Preventer are compatible and consistent with other previously-existing technologies. For example, large electromagnets, of the size and strength required may already be available for crane lifting purposes such as in metal recycling (also known as "junk") yards.

7. A Magnetorheological Blowout Preventer according to the present invention can be more conveniently implemented. In other words, the electromagnets used to convert the magnetorheological fluid from a liquid to a solid can be deployed at strategic locations along the well conduit with fewer fixtures and/or standoffs required. This could result in a substantial savings in hardware costs.

8. A Magnetorheological Blowout Preventer according to the present invention is comparatively simple with fewer failure mechanisms.

9. A Magnetorheological Blowout Preventer according to the present invention in no way jeopardizes the mechanical integrity of the well or any of its constituents.

10. A Magnetorheological Blowout Preventer according to the present invention, when implemented using powerful electromagnets in an under-sea platform installation has a convenient, unending supply of cooling water.

11. A Magnetorheological Blowout Preventer according to the present invention could be switched on very quickly. The magnetoviscous effect occurs on the order of a fraction of a second. This is very fast compared to a conventional Blowout Preventer that uses hydraulics to move heavy rams.

12. A Magnetorheological Blowout Preventer according to the present invention, when implemented using permanent magnets, will continue to benefit from the exponential growth in maximum energy product (BHmax) materials to be used in turning the fluid from a liquid to a solid.

13. A Magnetorheological Blowout Preventer according to the present invention, when deployed in a deep undersea installation might benefit from the surrounding temperature. For example, frozen ingots of magnetorheological fluid could be stored until such time when they are needed. When required, the frozen ingots would be heated up, thus allowing the magnetorheological fluid to melt and flow to the desired "kill" site.

14. A Magnetorheological Blowout Preventer according to the present invention would facilitate a so-called "Magnetic Junk Shot" to terminate the well. Following the release of an assortment of rare-earth, permanent magnets (and other bridging elements), magnetorheological fluid introduced into the well conduit and proximal to the permanent magnets, would instantaneously congeal into a solid plug thereby choking off the flow.

15. A Magnetorheological Blowout Preventer according to the present invention with its unique Magnetorheological Ram Heads will have the unprecedented ability to seal off virtually any cross sectional shape. Magnetorheological Ram Heads can accommodate buckled drill pipe, off-center drill strings and multiple blockage elements that would necessarily interfere with the operation of conventional ram heads.

16. A Magnetorheological fluid introduced into the well conduit can be used to plug a breach that occurs at any point downstream of where the fluid is introduced by simply placing a permanent magnet of sufficient size, strength and shape on the outside of said conduit in close proximity to the breach. In this instance, the magnetorheological fluid is meant to "heal" or "patch" the breach without fully terminating the flow.

17. A Magnetorheological Blowout Preventer according to the present invention may benefit unexpectedly from the natural magnetic constituents of an oil reservoir. For example, it is not uncommon for crude oil to contain trace iron particulates. Over time, a powerful electromagnet inside the wellbore might cause these particles to clump together, eventually clogging up the well.

18. A Magnetorehological Blowout Preventer according to the present invention may benefit unexpectedly from the natural magnetic constituents found within the cuttings as a result of drilling through iron-rich strata.

19. A Magnetorheological Blowout Preventer according to the present invention may benefit from the use of certain cementitious, epoxy-derived, sol-gel, liquid glass, cross-linking and/or other hardening agents that, when added to the magnetorheological fluid, allow the well to be permanently sealed off, even after the electromagnets are deactivated.

20. A Magnetorheological Blowout Preventer according to the present invention could potentially have prevented the 2010 Macondo Well (aka Deepwater Horizon) Disaster in the Gulf of Mexico where it has been suggested that a portion of buckled drill pipe was trapped outside of the shearing blade surfaces in the conventional BOP.

21. A BOP that combines mechanical blockage and magnetic blockage to form a "plug" (see DEFINITIONS section) across the well conduit. For example, in some embodiments, the moveable member(s) used to form a mechanical blockage are simultaneously utilized to generate a magnetic field necessary to activate a magnetic and/or magnetically pluggable fluid.

22. A BOP that people and/or automatic control algorithms will be more willing to activate and/or more willing to activate sooner than with conventional BOP's. This is because some embodiments according to the present invention do no permanent damage to the drilling equipment (for example, they don't shear through the drill string), so the economic losses are considerably less when the BOP is activated to form a plug in an abundance of caution, even in situations where it turns out, in 20-20 hindsight, that the plug was not really needed. In other words, the present invention may encourage drilling and/or pumping control to err on the side of safety.

According to one aspect of the present invention, a blowout preventer includes: a wellbore conduit portion; a magnet set including at least one magnet; and magnetic fluid. The wellbore conduit portion is connectable into fluid communication with a wellbore conduit. The wellbore conduit portion and the magnet set are sized, shaped, connected, structured and/or located so that a conduit sealing formation will form when the following two conditions are met: (i) the magnet set is configured to generate a magnetic field, and (ii) the magnetic fluid is caused to flow in the wellbore conduit portion.

According to a further aspect of the present invention, a device includes: a magnetically pluggable fluid; a wellbore conduit portion; and a magnet set including at least one magnet. The wellbore conduit portion is structured, sized and/or shaped to be connected in fluid communication with a wellbore conduit. The wellbore conduit portion and the magnet set are sized, shaped, connected, structured and/or located so when the following two conditions are met: (i) the magnet set configured to generate a magnetic field, and (ii) magnetically pluggable fluid is caused to flow in the conduit at least in a vicinity of the set of magnet(s), then at least one of the following results will be caused: (i) a conduit sealing formation will form in the wellbore conduit portion, and/or (ii) a flow rate of fluid through at least part of the well bore portion will substantially change.

According to a further aspect of the present invention, a method for forming a plug in a wellbore conduit, includes the following steps (not necessarily in the following order): (i) providing a magnet set, including at least one magnet, configured to generate a magnetic field in the vicinity of a kill zone portion of the wellbore conduit portion; and (ii) flowing magnetic fluid through the kill zone so that a conduit sealing formation is formed at least in part by the magnetic action of the magnetic fluid.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
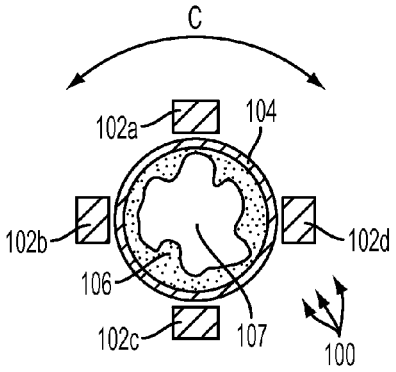
FIG. 1 is a transverse cross-sectional view of a first embodiment of a flow prevention system according to the present invention.

All things considered, both the Ram-type and the Annular-type Blowout Preventers require numerous mechanical parts that must work in near-perfect unison in order to guarantee flawless performance as fail-safe devices. The required degree of mechanical precision and/or co-operation means that these conventional types of BOP's are at greater risk of failure when subjected to extreme conditions of temperature, pressure, impact forces (for example, explosions), vibrations, corrosion and/or any other extreme stimulus which might cause any of the mechanical parts (for example, the drill string, riser or casing) to deform, break or otherwise fail. Moreover, these complex assemblies are subjected to ever-harsher operating conditions as societies needs continue to push the envelope of petroleum exploration. As a result, it is expected that these assemblies will fail with greater frequency.

To help resolve these conflicting imperatives (that is, simplification of Blowout Preventers in ever-more-complex operating environments), a fundamental change in design philosophy is posited by some embodiments of the present invention. Rather than controlling the flow of a fluid (oil and/or natural gas) with ever-more-complicated mechanical systems, we propose that a simpler and more elegant approach would keep everything in the fluid domain. In other words, let us control the flow of one fluid (oil and/or natural gas) with another fluid (a so-called magnetic fluid and/or magnetically pluggable fluid).

The term "magnetic fluid" as used herein and throughout, shall mean any fluid (now known or to be developed in the future) that is responsive to a magnetic field. Magnetic fluids are comprised of magnetic or magnetizable particles suspended in a carrier liquid with stabilizing agents (i.e. surfactants, anti-agglomerating agents and/or anti-settling agents). Another term used herein is "magnetically pluggable fluid," and this term has a somewhat different definition that is set forth in the DEFINITIONS section. Magnetic fluids are characterized by their: volume, particle size (including the distribution of sizes), particle shape (including the distribution of shapes), particle composition (including magnetic permeability and hardness of same), volume fraction of particles, carrier liquid and any number of other sparse additives such as, stabilizers (that is, surfactants, anti-agglomeration agents and/or anti-settling agents), lubricants, anti-oxidants, etc that further serve to functionalize the magnetic fluid for a specific application.

Magnetic fluids are typically categorized according to the size of the magnetic or magnetizable particles contained therein. Magnetic fluids with particles in the diameter range from about 3 nm to about 15 nm are called "ferrofluids." Particles in this size range possess a single magnetic domain only. As such, they are in a permanent state of magnetization (even in the absence of an external magnetic field). This results in a long-range magneto-static attraction between the particles that causes them to clump together. To prevent this agglomeration, surfactants are used with long-chain molecules that adhere to the surface of each particle causing them to elastically rebound away from each other. As used herein and throughout, the term "ferrofluid" shall mean a colloidal suspension of surfactant-coated, nanometer-sized, magnetic particles immersed in a carrier liquid that exhibits a small change in viscosity as a function of an externally-applied magnetic field.

Preferably, but not necessarily, the magnetic particles contained in a ferrofluid will include: iron (Fe), cobalt (Co), nickel (Ni), magnetite ($Fe_3O_4$), maghemite ($Fe_2O_3$), and/or combinations thereof.

Preferably, but not necessarily, the carrier liquid in a ferrofluid might consist of water, salt water, hydrocarbons, fluorocarbons, mineral oil, vegetable oil, silicone oil, synthetic oil, petroleum oil, alcohol, glycol, kerosene, transformer oil, diester, toluene, benzene, styrene, chloroform, carbon tetrachloride, perfluoropolyethers, and/or combinations thereof.

Preferably, but not necessarily, the stabilizers (i.e. surfactants, anti-agglomerating agents and/or anti-settling agents) contained within a ferrofluid will include: stearic acid, oleic acid, citric acid, soy lecithin tetramethylammonium hydroxide. Other stabilizers include: soaps of fatty acids (oleates of sodium, potassium, ammonium, aluminum stereate and naphthenate, and disodium salt of ethers of succinic acid), sulfonates (tritanolamine salt of laurylsulphate, dodecylbenzosulphate, and a mixture of alkyl sulfonates), alcohols (polyvinyl, stearyl, octadecyl, polyisobutyl, and polyisopropyl), esters (polyoxyethylene, a mixture of polyethylene glycol esters of mono- and dialkylphenols OP-7 and OP-10, and dodecyl esters of phthaleic acid) and amines (dodecylamine, undecylamine, and amines of the group of aminolaurine propyonates), Polyisobutene succinic acid (PIBSA), Dodecylamine, Polyisobutene (PIBA), alkylguanidine amine complex and lignosulfonate.

Ferrofluids of various types are commercially available from FerroTec (Nashua, N.H. (USA)), FerroLabs (Dulles, Va. (USA)) and Liquids Research Limited (Bangor, North Wales).

A second class of magnetic fluid results for magnetic particles in the diameter range from about 1 um to about 10 um. These so-called magnetorheological (MR) fluids are important because they exhibit a very large (~several orders of magnitude) and very fast (~millisecond) change in viscosity as a function of an externally-applied magnetic field (the magnetoviscous effect). Particles in this size range are multi-domain with an average magnetization that is nearly zero. As used herein and throughout, the term "magnetorheological fluid" shall mean a non-colloidal suspension of surfactant-coated, micrometer-sized, magnetizable particles immersed in a carrier liquid that exhibits a large change in viscosity as a function of an externally-applied magnetic field.

Figure 10A:
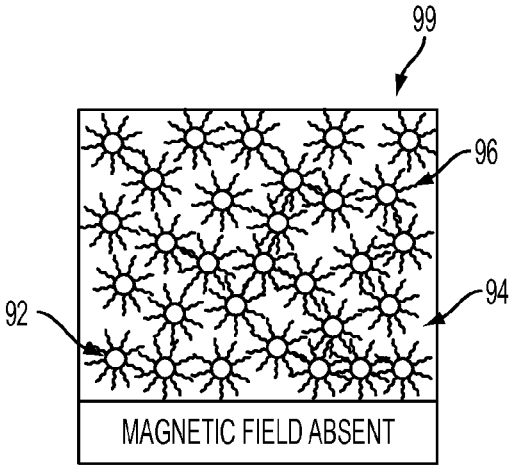
FIG. 10A is a diagram helpful in explaining certain principles used in the present invention.
Figure 10B:
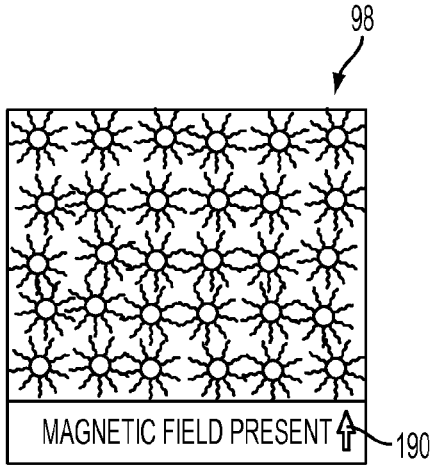
FIG. 10B is a diagram helpful in explaining certain principles used in the present invention.

FIGS. 10A and 10B show how a magnetic field will change the viscosity of a magnetorheological fluid. As shown in diagram 99 of FIG. 10A, in the absence of a magnetic field, the magnetizable particles 92 contained in a magnetorheological fluid are randomly distributed within the carrier liquid 94. Further included in FIGS. 10A and 10B are the long-chain surfactant molecules 96 adhered to each particle to mitigate the effects of sedimentation and agglomeration. When a magnetic field 190 is applied to the MR fluid, as shown in diagram 98 of FIG. 10B, these same magnetizable particles form chain-like structures in the direction of the magnetic field that tend to impede macroscopic flow of the fluid, thereby increasing its viscosity. Magnetorheological fluids in the "on" state (that is, in the presence of a magnetic field) behave theoretically like "Bingham" plastics with semi-solid-like characteristics. In the "off" state (that is, in the absence of a magnetic field) magnetorheological fluids behave theoretically like "Newtonian" fluids with conventional liquid-like characteristics. Interestingly, the volume of a magnetorheological fluid generally remains constant in each of these two states. The viscosity of a magnetorheological fluid in the "off" state depends on the viscosity of the carrier liquid, the volume fraction of particles present, the size/shape of the particles, the amount and type of additives present, and the shear rate at which the viscosity is measured. In addition to these, the viscosity of an MR fluid in the "on" state also depends on the magnitude of the magnetic field present.

Preferably, but not necessarily, the magnetizable particles in a magnetorheological fluid will comprise: elemental iron, cobalt and nickel, carbonyl iron (see BASF of Ludwigshafen, Germany), iron powder and/or iron filings.

Preferably, but not necessarily, the carrier liquid in a magnetorheological fluid will comprise: water, salt water, hydrocarbons, fluorocarbons, mineral oil, vegetable oil, silicone oil, synthetic oil, petroleum oil, alcohol, glycol, kerosene, transformer oil, diester, toluene, benzene, styrene, chloroform, carbon tetrachloride, perfluoropolyethers, and/or combinations thereof.

Preferably, but not necessarily, the stabilizers (i.e. surfactants, anti-agglomerating agents, anti-settling agents and/or thixotropic agents) contained in a magnetorheological fluid will include one or more of the following: soaps of fatty acids (oleates of sodium, potassium, ammonium, aluminum stereate and naphthenate, and disodium salt of ethers of succinic acid), sulfonates (tritanolamine salt of laurylsulphate, dodecylbenzosulphate, and a mixture of alkyl sulfonates), alcohols (polyvinyl, stearyl, octadecyl, polyisobutyl, and polyisopropyl), esters (polyoxyethylene, a mixture of polyethylene glycol esters of mono- and dialkylphenols OP-7 and OP-10, and dodecyl esters of phthaleic acid) and amines (dodecylamine, undecylamine, and amines of the group of aminolaurine propyonates), Polyisobutene succinic acid (PIBSA), Dodecylamine, Polyisobutene (PIBA), alkylguanidine amine complex, lignosulfonate, xantham gum, silica gel, stearates and carboxylic acid.

Magnetorheological fluids of various types are commercially available from LORD Corporation (Cary, N.C. (USA)), FerroLabs (Dulles, Va. (USA)) and Liquids Research Limited (Bangor, North Wales).

A third class of magnetic fluid results when surfactant-coated, micrometer-sized, non-magnetic particles are suspended in a ferrofluid. These so-called inverse or composite magnetorheological fluids have significant potential for use in a Magnetorheological Blowout Preventer, due in-part to the extensive choice of materials to be used for the non-magnetic particles. Either metallic or non-metallic (i.e. dielectric) particles are available for use, providing a rich assortment of available properties to be exploited. As used herein and throughout, the term "inverse magnetorheological fluid" or "composite magnetorheological fluid" shall mean a non-colloidal suspension of surfactant-coated, micrometer-sized, non-magnetic particles immersed in a ferrofluid that exhibits a change in one or more of its material properties as a function of an applied magnetic field.

In one embodiment, magnetorheological fluid in the form of magnetorheological drilling fluid (or magnetorheological mud) is pumped into the wellbore in the semi-liquid state. Subsequently, a plurality of external, circumferentially-arranged, electromagnets are "activated" by passing an electrical current through them. These electromagnets generate a magnetic field that permeates the wall of the wellbore conduit thereby causing the magnetorheological drilling fluid to transform into a "semi-solid plug" (see DEFINITIONS section) thereby restricting the flow of petroleum oil and/or natural gas effluent along the well.

Figure 2:
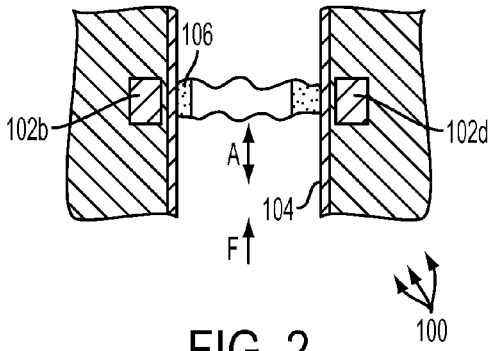
FIG. 2 is a longitudinal cross-sectional view of the first embodiment system.

FIGS. 1 and 2 show system 100, which is an example of the foregoing type of design. System 100 includes: circumferentially spaced magnets 102*a,b,c,d*; wellbore conduit 104; patch (or conduit sealing formation) 106; circumferential direction C; axial direction A; and flow direction F. The magnets may be either permanent magnets, electromagnets, or any other type of magnets now known or to be developed in the future. A particularly simple example of the embodiment described in FIG. 1 includes the use of a magnetorheological drilling fluid as a "healing" or "patching" agent. For example, should there occur an isolated breach (i.e. a small hole or tear) in the wellbore conduit, it would be possible to place a high-power rare-earth permanent magnet over-top of the breach (external to the conduit) for purposes of locally congealing the magnetorheological drilling fluid into a solid plug, thereby patching the breach. In this case, the plug is not meant to prevent fluid flow along the conduit. Rather, in this case, the plug is only meant to patch the hole in the conduit. Preferably, but not necessarily, the face of the magnet would be machined so as to make intimate contact with the outer surface of the conduit. While most embodiments of the present invention discussed herein make plugs (to substantially block fluid flow through the conduit), some will form patches to help prevent fluid from substantially escaping from the confines of the conduit. Collectively, plugs and patches will be referred to herein as "conduit sealing formations." While FIG. 1 shows a patch, rather than a plug (note free flow zone 107), if the magnets 102*a,b,c,d* were made stronger then the free flow zone would be expected to close up in the center and conduit sealing formation 106 would be both a patch and a plug.

Figure 3:
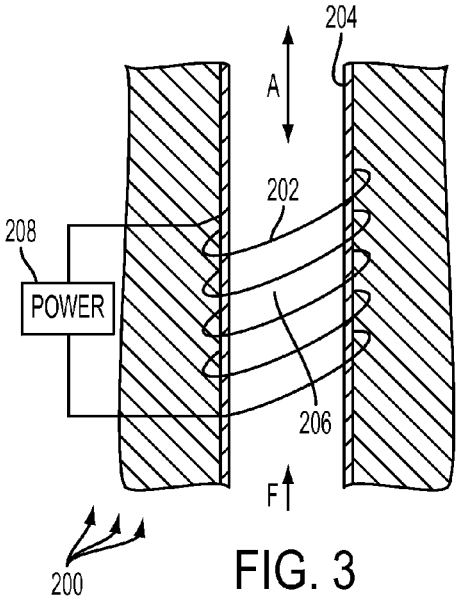
FIG. 3 is a longitudinal cross-sectional view of a second embodiment of a flow prevention system according to the present invention.

In another embodiment, insulated wire is wound around the wellbore conduit numerous times much like a solenoid with an axial (that is, along the axis of oil and/or gas flow) magnetic field resulting. When electrical current is passed through the windings, the magnetic field will cause the magnetorheological fluid introduced inside the wellbore conduit to become a semi-solid plug, thereby stopping up the well. FIG. 3 shows system 200, which is an example of the foregoing type of design. System 200 includes: current carrying windings 202; wellbore conduit 204; plug zone 206; power supply 208; axial direction A; and flow direction F.

Figure 4:
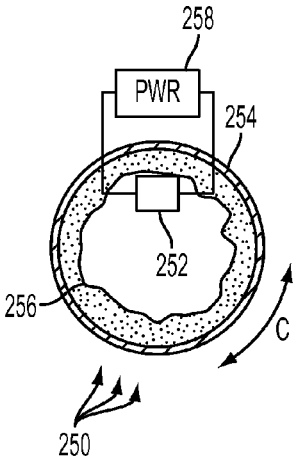
FIG. 4 is a transverse cross-sectional view of a third embodiment of a flow prevention system according to the present invention.
Figure 5:
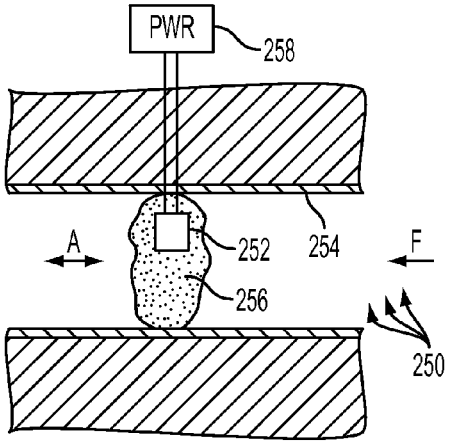
FIG. 5 is a longitudinal cross-sectional view of the third embodiment system.

In another embodiment, one or more electromagnets are located inside the wellbore conduit. These electromagnets may be designed so that the oil and/or gas effluent can travel around them in a laminar manner (that is, with reduced turbulence) when the electromagnets are in the "off" state. However, when the electromagnets are activated, they will cause the magnetorheological fluid released into the wellbore conduit to congeal into a solid plug thereby choking off the well. FIGS. 4 and 5 show system 250, which is an example of the foregoing type of design. System 250 includes: inside-the-wellbore-conduit electromagnet 252; wellbore conduit 254; plug 256; power supply 258; circumferential direction C; axial direction A; and flow direction F.

Figure 6A:
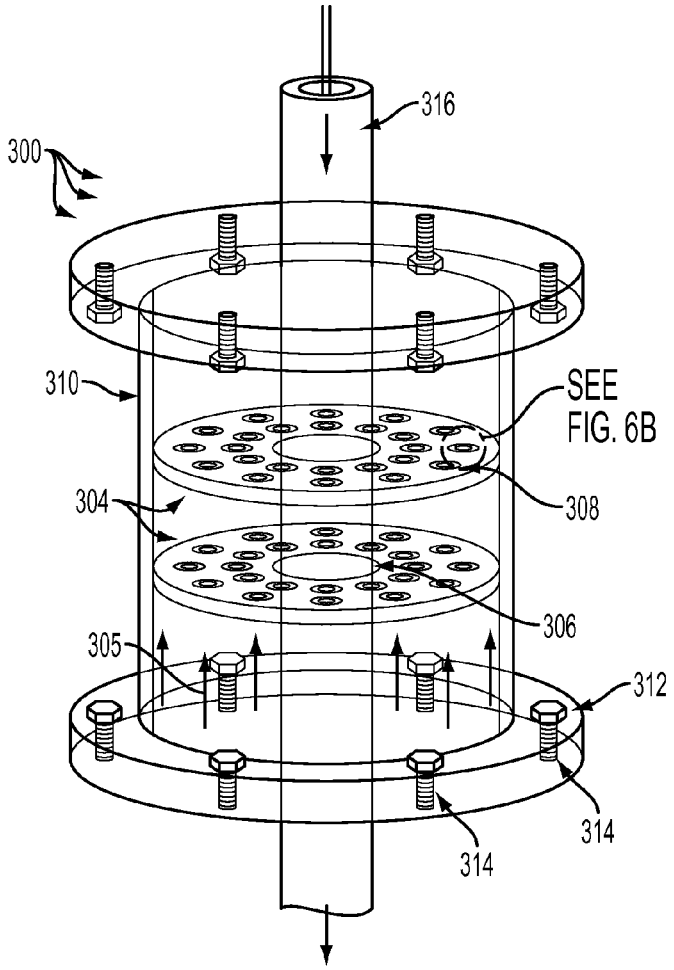
FIG. 6A is a perspective view of a fourth embodiment of a flow prevention system according to the present invention.
Figure 6B:
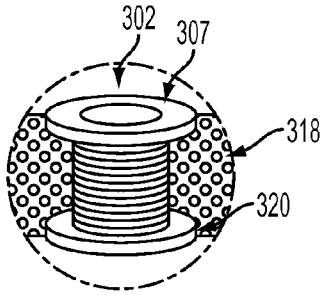
FIG. 6B is a perspective view of a portion of the fourth embodiment system.

A Solenoid Grating Array embodiment is shown in FIGS. 6A and 6B wherein system 300, is comprised of multiple solenoids 302 arranged over two annular grating members 304. The outer diameter 308 of each annular grating member 304 is mounted to the housing 310. And, a Bolt Flange 312 with circumferentially-spaced Bolts 314 are used to mount the system 300 onto a wellhead. The inner diameter 306 of each annular grating member 304 is selected so as to allow the drill string 316 to rotate freely therein. In this embodiment, each solenoid 302 is comprised of an electrically conductive winding 318 wrapped about a mandrel 320 that is fastened to the body of the annular grating member and the solenoid inner diameter is selected to be large enough to pass drilling fluid and cuttings. However, when closing off the well, each of the solenoids will be activated by passing an electrical current along each of their windings. After activation, an upstream reservoir of magnetorheological fluid will be opened. And, the magnetorheological fluid will flow along the wellbore conduit until it sees the magnetic field generated by the solenoids, at which point, the core space 307 of each solenoid 302 will become blocked, and a plug will be formed by the annular grating member taken in combination with the magnetically-induced blockages in each solenoid. In this particular embodiment, because the solenoids can be individually controlled, the pressure holding capacity of each individual plug can be tuned for optimal response by increasing or decreasing the current flowing in each winding. In this way, the spatial distribution of the plug (that is, the plug profile) can be optimized for the needs at hand.

A Solenoid Grating Array would be particularly well suited for a "Magnetic Junk Shot". The term "Junk Shot" is a colloquialism for a procedure wherein "bridging elements" (plastic cubes, knotted rope, even golf balls) are pumped into a failed blowout preventer to try and clog it up after its normal mode of operation has failed. In this instance, a Magnetic Junk Shot would be comprised of high-power, permanent magnets introduced into the effluent stream wherein they would travel along the wellbore conduit and stick to (that is, be attracted to) an annular grating member made of iron for instance. In this scenario, the size of the permanent magnets could be selected so that they are larger than the inner diameter of the solenoids (i.e. they cannot pass through them readily). If the magnets accumulated against the annular grating members do not form a "plug" by themselves, then we can release magnetorheological fluid from an upstream reservoir. When the magnetorheological fluid meets up with the magnetic bridging elements adhered to the annular grating members, it will congeal to help form a "plug," thereby stemming the flow of natural gas and/or petroleum effluent 305 along the wellbore conduit. As an aside, an annual grating member without any solenoids present could also function in a similar manner. So long as the holes in the grating were smaller than the permanent magnets (that is, magnetic bridging elements) introduced, they should be captured by it. And, after enough magnets have accumulated, any magnetorheological fluid introduced proximal to would fill-in all the nooks and crannies in-between the magnetic bridging elements thereby terminating the flow of effluent.

By way of example, assume that we place an annular grating member inside the wellbore casing with a hole at its center for the drill string to rotate freely and many smaller holes around the periphery. Now, ordinarily, the oil would pass through the grating because the holes in the periphery are large enough to allow the oil and drill cuttings to pass. Now let's say there is a blowout that occurs and we wish to stop the uncontrolled flow of oil. What we can do is introduce many hundreds of these permanent magnets (maybe in cube or spherical form). Each small magnet could be pushed for example into the flow stream by a small piston for example (upstream of the grating). Or, each small permanent magnet could be held in place by an electromagnet until it is necessary to be released. So, there would be many hundreds of these small, permanent magnets released into the flow stream and they would barrel down the wellbore casing, under the influence of the flow of high pressure oil and/or gas effluent. Eventually, they would come to rest against the annular grating member (i.e. these magnets would be specifically chosen not to fit through the holes in the grating so they get caught by the grating). But there will be many smaller holes in between the bridging elements through which the oil can still pass. Now add the MR fluid which bridges these smaller holes thereby forming a liquid tight plug that envelopes the grating.

Figure 7:
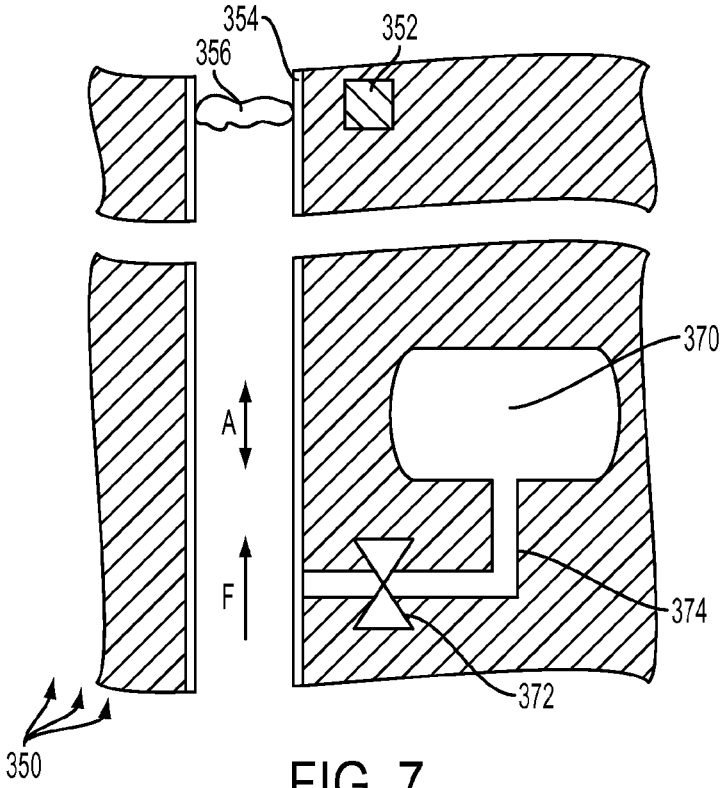
FIG. 7 is a longitudinal cross-sectional view of a fifth embodiment of a flow prevention system according to the present invention.

In some embodiments, the Magnetorheological Blowout Preventer system according to the present invention will further include a reservoir of magnetorheological fluid maintained until such time that its contents are needed (for example, in time of an emergency). When needed, the magnetorheological fluid is purposefully released upstream of the plug site. There are several ways to accomplish this holding and controlled release of the magnetic fluid, such as the following: (i) maintaining the magnetic fluid supply in a frozen state, and thawing it to release it; (ii) holding the magnetic fluid supply in place with a magnet (such as an electromagnet) and removing the magnetic field to release the fluid; (iii) using traditional fluid flow hardware such as tanks, pipes, pumps, mixers and/or valves; and/or (iv) using a supply of solid magnetic particles (for example, solid iron particles) that may be controllably released into the effluent stream thereby forming a magnetically pluggable fluid which will then travel to the vicinity of the plugging magnet(s). FIG. 7 shows system 350, which is an example of the foregoing type of design. System 350 includes: magnet 352; wellbore conduit 354; plug 356; magnetic fluid supply tank 370; fluid supply line 374; valve 372; axial direction A; and flow direction F. The valve might be of any type now know or to be developed in the future, such as a mechanical valve or a magnetic valve. While this embodiment includes a tank and a valve, the reservoir of magnetic fluid may be held and released (in a controllable manner) by other means. For example, the reservoir could be comprised of an ensemble of hollow magnetic microspheres filled with magnetorheological fluid (and/or some other instantaneous hardening agent) that burst or otherwise release their contents in the presence of a magnetic field.

Figure 8:
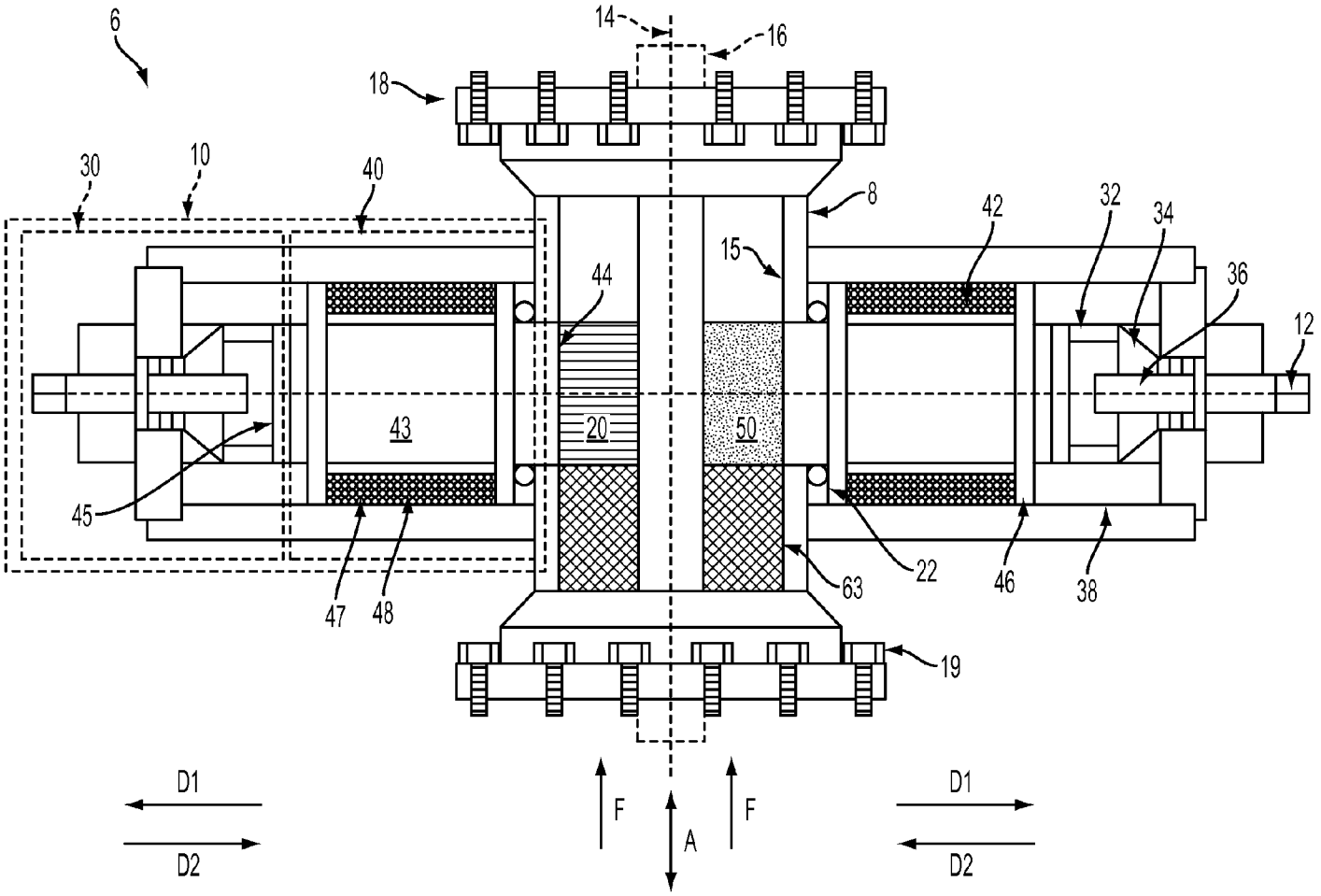
FIG. 8 is a longitudinal cross-sectional view (cross hatching omitted for clarity of illustration purposes) of a sixth embodiment of a flow prevention system according to the present invention.

FIG. 8 shows a Magnetorheological Blowout Preventer 6 according to one embodiment of the present invention wherein Main Body 8 supports two or more Ram Assemblies 10 attached thereto for purposes of terminating the flow of natural gas and/or petroleum effluent 52 along Wellbore Axis 14. Each Ram Assembly 10 is comprised of a Mechanical Piston Assembly 30 and a Magnetic Piston Assembly 40 with a common axis 12 that is more or less perpendicular to the Wellbore Axis 14. Each Mechanical Piston Assembly 30 is further comprised of a Mechanical Piston 32 with a Threaded Shoulder 34, a Threaded Shaft 36 and a Piston Guide 38. Each Magnetic Piston Assembly 40 is further comprised of an Electromagnet 42, with a Core 43 (also referred to herein as a Magnetic Piston), a First Pole Face 44 adjacent to a volume of Magnetorheological Fluid 50 and a Second Pole Face 45 adjacent to said Mechanical Piston 32. Further included in the Electromagnet 42 is a Bobbin 46 (alternatively and equivalently referred to as a mandrel or former) around which Conductive Windings 47 and Cooling Conduit 48 are wound.

When activated (that is, when passing an electrical current along the Conductive Windings 47), the electromagnet 42 will generate a magnetic field that transforms the Magnetorheological Fluid 50, flowing in the direction of Wellbore Axis 14, adjacent to Pole Face 44 into a Solid Plug 20 that fills the annular volume of space between the inner surface of the Housing Conduit 15 and the outer surface of the Drill String 16. In this way, Pole Face 44 of Magnetic Piston 43 is effectively extended into the flow region as a Magnetorheological Ram Head. This plug 20, as it solidifies, will conform to any necessary shape, and fill any gaps, required to form at least a "plug" (see DEFINITIONS section) and preferably even a fluid tight seal.

Additional components of the Magnetorheological Blowout Preventer 6 may include Bolt Flange 18 with circumferentially deployed Bolts 19 for mating to the riser, well casing and/or additional Blowout Preventers in a Blowout Preventer Stack configuration. Additional components of the Magnetorheological Blowout Preventer 6 may further include Elastomeric Seal 22 that prevents oil/gas effluent from entering Ram Assembly 10.

When not in use (i.e. when it is not engaged to stop the flow of natural gas and/or petroleum effluent along the wellbore conduit) the Magnetorheological Blowout Preventer 6 will have the Magnetic Pistons 43 partially retracted (that is moved in direction D1) away from the center of the Wellbore Axis 14, thereby allowing maximum flow of mud and/or oil through the interior space between the inner wall of the Housing Conduit 15 and the outer wall of the Drill String 16.

When engaged (that is, during an emergency or in expectation of a possible emergency), current will be passed along the Electrically Conductive Windings 47 of the Electromagnet 42 which in turn will generate a powerful Magnetic Field. This Magnetic Field will interact with the Core (also known as Magnetic Piston) 43 in two ways. First, the Magnetic Field will draw the Magnetic Piston 43 radially inward (that is, in the direction of arrow D2) towards the Wellbore Axis 14. And second, the Magnetic Field will cause the Magnetorheological Fluid 50 to solidify into a Solid Plug 20 in any remaining gap between Pole Face 44 and Drill String 16, thereby forming a plug, and perhaps even completely stopping the flow of natural gas and/or petroleum effluent.

Before excitation (that is, in the absence of a magnetic field), the Magnetorheological Fluid 50 will flow past the Plug Location 20 as a liquid, thereby filling up the annular volume between the inner surface of the Housing Conduit 15 and the outer surface of the Drill String 16. In this way, virtually any geometry can be accommodated because a fundamental characteristic of any liquid is that it will fill up the volume of its container.

One potential, and potentially great, advantage of the present invention is that the ram heads need not shear through the drill string, nor must they be precision-machined to match the outer diameter of the drill string. Because the magnetic field generated by the electromagnets permeates both the annular volume of space outside the drill string and the inner volume of space inside the drill string, a plug can be formed in both of these regions simultaneously. As a result, in the event of an explosion that might warp the ram heads, force the Drill String Off-Center or place other ancillary items into the path of the rams, the Magnetorheological Ram Heads will simply "morph" into whatever shape is necessary to close off the well. This characteristic is expected to usher in heretofore unprecedented levels of reliability in the design of modern day blowout preventers.

In addition to the Magnetic Piston Assembly 40 and its Magnetorheological Ram Head in the presence of a magnetic field, each Ram Assembly 10 may further comprise a Mechanical Piston Assembly 30 that serves as an auxiliary method for pushing against the Magnetic Piston 43. In FIG. 8, Mechanical Piston Assembly 30 is engaged by turning the Threaded Shaft 36 about Axis 12 such that Threaded Shoulder 34 applies an axial force against Mechanical Piston 32 which slides along the Piston Guide 38. This may be advantageous because it helps to reduce the distance between the Pole Face 44 and the Drill String 16 which in turn enables a stronger interaction between the Magnetic Field and the Magnetorheological Fluid.

In FIG. 8, the Mechanical Piston Assembly 30 could be replaced by a Hydraulic Piston Assembly. The Mechanical Piston Assembly was included in this figure for simplicity of discussion. It is further noted that not all embodiments of the present invention will necessarily have a mechanical piston or a magnetic piston, even though both types of pistons can be useful in effecting a mechanical blockage across a portion of the well conduit to help form a plug, acting in conjunction with the magnetic action of the present invention. It is also noted that a moveable mechanical blockage member in a BOP of the present invention could be provided separately from the magnet, and perhaps even upstream or downstream of the vicinity where the magnetic field is strongest. As a further variation, the electromagnet coils could be moved at least partially into the interior space of the housing, along with the core.

Specifically not shown in FIG. 8 is a reservoir to hold the Magnetorheological Fluid (or solid(s) that can be injected into a fluid stream to create Magnetorheological Fluid) prior to its use in forming a plug. The reservoir can be located at any convenient point upstream of the Magnetorheological Blowout Preventer. The Magnetorheological Fluid can be stored inside the Magnetorheological Blowout Preventer Housing. Or, it can be pumped into the Housing where necessary so that the flow of natural gas and/or petroleum effluent causes it to flow past the plug site just prior to engaging the electromagnets. Wherever the reservoir is located, its purpose is to house the magnetorheological fluid until such time that it is needed. In an emergency, the reservoir will be opened so that the magnetorheological fluid will flow to the Kill Zone 20 inside the Magnetorheological Blowout Preventer where the electromagnets will cause it to form a plug.

Preferably, but not necessarily, each Magnetic Ram Assembly will be independently operated from every other Magnetic Ram Assembly with regard to Mechanical Piston Pressure and the electrical current magnitude and direction passed along the conductive windings of each electromagnet. However, well known in the field of electromagnet design, the core or yoke of an electromagnet can sometimes take on numerous different shapes (a horseshoe shape for instance) in order to control the direction of the magnetic field lines (that is, to complete a magnetic circuit). As a result, there may be certain economies and advantages realized when two or more of the Magnetic Ram Assemblies utilize a common yoke and/or common windings.

Preferably, but not necessarily, the Magnetorheological Blowout Preventer is comprised of 2, 4 or 6 independent Magnetic Ram Assemblies in a single Housing that are circumferentially and equally spaced at 180 degrees (Dipole), 90 degrees (Quadrupole) or 60 degrees (Sextupole) configurations respectively, so that each Magnetic Ram Assembly has a partner with the same axis on the opposite side of the Housing. A Magnetorheological Blowout Preventer with multiple Magnetic Ram Assemblies will benefit from a larger magnetic field and a corresponding increase in its ability to hold back greater oil and/or natural gas effluent pressure.

Depending on how the poles of these multiple, Magnetic Ram Assemblies are oriented relative to each other and to the conduit (for example, in attraction, in repulsion, direction of electrical current flow, etc) there can be a level of sophistication never-before achieved. For example, in a conventional Quadrupole configuration (with two opposing North poles and two opposing South poles), the magnetic field in the exact center of the assembly is zero and it increases very quickly away from the center. This could be used to great advantage in a Magnetorheological Blowout Preventer. For example, if the magnetic field is nearly zero at the center of the housing (where the drill string is located), that means the viscosity of magnetorheological drilling fluid would be very low on the way down. However, the magnetic field of this same Quadrupole configuration would be tremendously strong as one moves away from the center of the well-conduit axis. And thus, the viscosity of the magnetorheological drilling fluid would be much greater outside of the drill string (in the annular region between the outer diameter of the drill string and the inner diameter of the housing). This significant viscosity differential could play an important role in the development of future mud pumps for example, or some other relevant petroleum exploration equipment. Or, such sophistication could be used for example, to limit the transverse extent of the plug so that the drill string can continue to rotate in the presence of the plug.

A particularly intriguing advantage of some embodiments of the present invention would make use of cementitious, epoxy-derived, sol-gel, liquid glass, cross-linking and/or other hardening agents so that, after a period of time, the magnetorheological fluid in the region of the electromagnets (i.e. the Kill Zone) would permanently solidify, after which the electrical current supplied to the electromagnets could be turned off. In this particular instance, for purposes of economy (i.e. since large electromagnets can be very expensive), after the magnetorheological "cement" has permanently cured, the electromagnets can be removed from the housing and transported to a new deployment location. In this way, the same set of magnets can be used on multiple wells.

Figure 12:
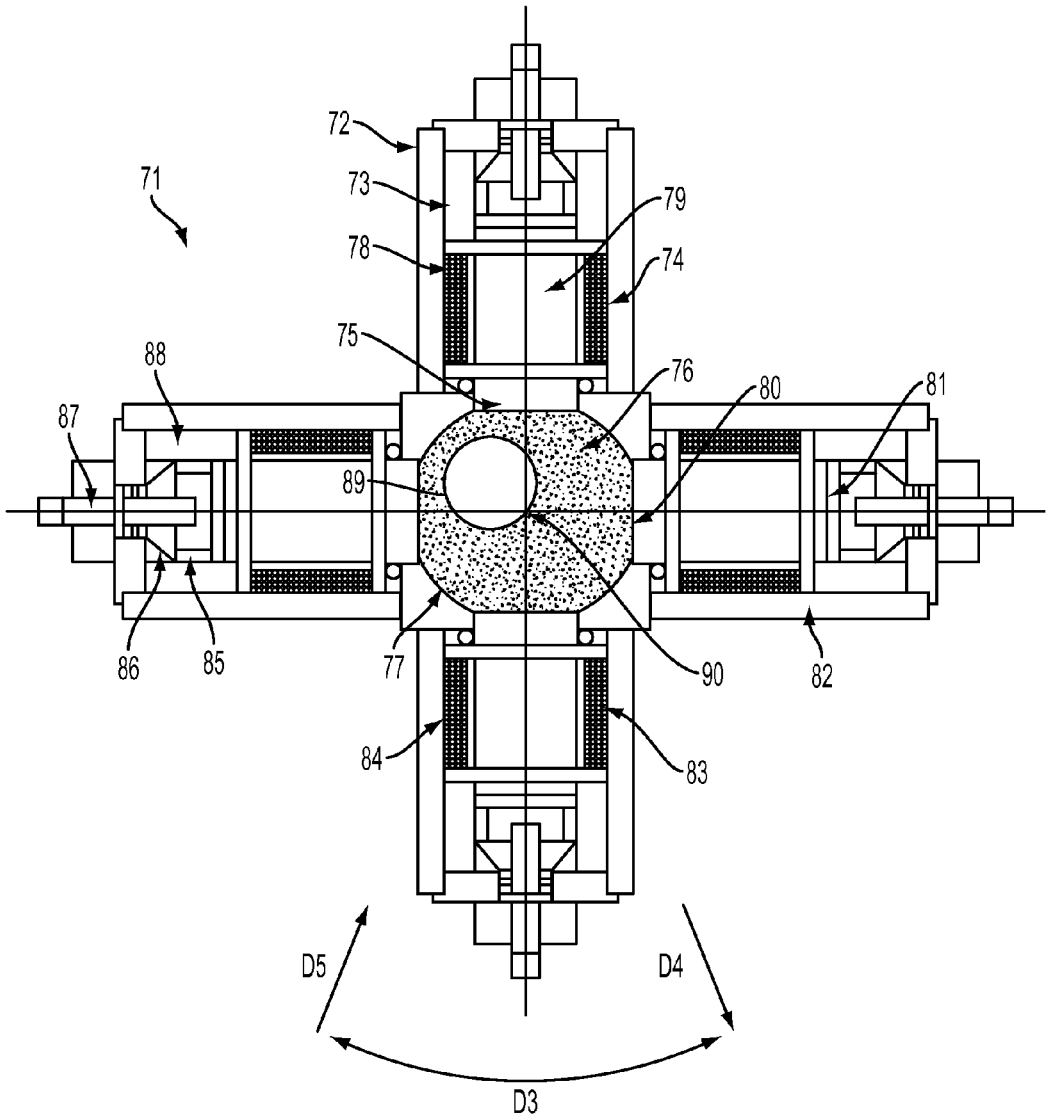
FIG. 12 is a transverse cross-sectional view (cross hatching omitted for clarity of illustration purposes) of an eighth embodiment of a flow prevention system according to the present invention.

FIG. 12 illustrates a Quadrupole Magnetorheological Blowout Preventer 71. BOP 71 has a total of four Magnetic Ram Assemblies 72 each comprising a Mechanical Piston Assembly 73, Magnetic Piston Assembly 74, Magnetorheological Ram Head 75 and Magnetorheological Fluid 76 contained in casing 77 wherein each Magnetic Piston Assembly is further comprised of an Electromagnet 78 with a Core (also known as Magnetic Piston) 79, Pole Faces 80, Pole Faces 81, a Bobbin/Mandrel 82, Conductive Windings 83 and Cooling Conduit 84. And, the Mechanical Piston Assembly 73 is further comprised of a Mechanical Piston 85, a Threaded Shoulder 86, a Threaded Shaft 87 and a Piston Guide 88. Also shown in FIG. 12 are Drill String 89 and Wellbore Axis 90. In this embodiment the flow direction is along the Wellbore Axis 90, and more specifically in a direction coming out of the plane of the page. The Wellbore Axis 90 defines an angular direction D3, a radially inwards direction D5 and a radially outwards direction D4.

In the particular embodiment shown in FIG. 12, the Drill String 89 has moved dangerously off-center which might cause a conventional blowout preventer to fail. However, for the Magnetorheological Blowout Preventer, the magnetic fluid easily flows around the decentralized drill string and solidifies in place thereby plugging up the non-symmetrical volume between the outer surface of the Drill String 89 and the inner surface of the blowout preventer Housing 17. Even if the Drill String sheared off (due to an unforeseen explosion) and there were two portions of the Drill String in the blowout preventer housing, the magnetorheological fluid would simply flow around both of them to fill the general void before congealing into a solid plug when the electromagnets are activated. Such is the morphing nature of Magnetorheological Ram Heads.

Preferably, but not necessarily, two or more Magnetorheological Blowout Preventers would be deployed at multiple locations along the well conduit to form secondary and tertiary plug locations for increased pressure capacity.

As an aside, it should be noted that crude petroleum oil can sometimes contain sparse magnetic particles (those particles derived from magnetic elements such as Iron, Cobalt and Nickel for instance). As a result, when the crude petroleum flows past the core of the electromagnets, magnetic particles will tend to accumulate and stick to the Pole Face. Over time, this process will begin to restrict the flow opening until it closes altogether. However, it remains to be seen whether a system that relies heavily on the natural fluid of the oil well to help form its plug would require an unacceptable amount of oil to flow past the Kill Site before a "plug" is formed.

As an aside, it should be noted that crude petroleum oil could in fact fulfill the function of a Carrier Liquid in a Magnetorheological Fluid or a Ferrofluid. In this case, a reservoir of appropriately-sized, surfactant-coated, magnetic particles could be positioned upstream of the intended plug location. When activating the Magnetorheological Blowout Preventer, the reservoir would release these particles into the crude petroleum flow stream, thereby transforming the crude into a magnetic fluid of sorts that will form a solid plug as it reaches the Pole Faces of the Magnetic Ram Assemblies. In some embodiments, these appropriately sized particles could: (i) be magnetizable, rather than magnetic; and (ii) could be larger even than the particles of magnetorheological fluid.

As used herein and throughout, the term "Drill String" shall refer colloquially to the column (also known as string) of various components (Drill Pipe, Transition Pipe, Collars, Drill Stem Subs and Other Items) that, when properly assembled, will supply the necessary torque and drilling fluid to the drill bit. In other embodiments of the present invention, and especially embodiments that are not directed to oil-extraction-related conduits, there may be no drill string and/or or no hardware analogous to a drill string. In other embodiments of the present invention, and especially embodiments that are not directed to oil-extraction-related conduits, there may be other hardware located transversely across a portion of the interior space of the fluid carrying conduit. System 300, discussed above in connection with FIG. 6, is just one example of such an embodiment. Depending upon the geometry of such hardware, it might be helpful in forming a magnetic core (permanent type or electromagnet type).

As used herein and throughout, the term "Wellbore" shall refer to any hole that is drilled for purposes of exploration or extraction of natural resources including, but not limited to, water, natural gas and/or petroleum.

As used herein and throughout, the term "Casing" shall refer colloquially to a conduit that is placed into the wellbore itself, or is used peripherally or above it to protect and manage the natural gas and/or petroleum effluent from the well.

"Conduit" shall mean any closed structure (for example, a pipe, but not the Earthen wellbore) designed to guide a fluid stream through an elongated interior space, without limitation with respect to: (i) cross-sectional shape; (ii) cross-sectional uniformity; (iii) reinforced versus unreinforced; (iv) scale (for example, medical device scale versus oil well scale); (v) indoor or outdoor location; (vi) above ground versus below ground location; (vii) above sea versus subsea location and/or (viii) presence or absence of hardware in the interior space of the conduit. One type of conduit, called a "wellbore conduit" is defined below in the DEFINITIONS section.

Figure 9:
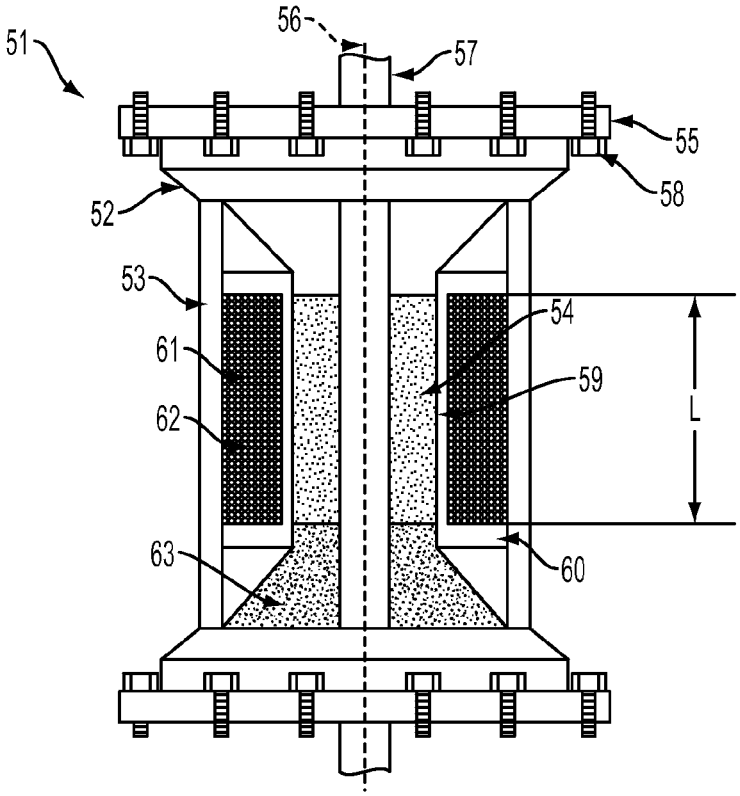
FIG. 9 is a longitudinal cross-sectional view (cross hatching omitted for clarity of illustration purposes) of a seventh embodiment of a flow prevention system according to the present invention.

An alternative Magnetorheological Blowout Preventer 51 according to the present invention is shown in FIG. 9 wherein Housing 52 supports one or more Electromagnets 53 that are further comprised of Electrically Conductive Windings 61 and Cooling Tubes 62 wound about a Bobbin 60 that is further disposed about Conduit 59. In this particular embodiment, the Electrically Conductive Windings 61 are wound about the Conduit 59 in a Solenoid-Like configuration wherein the Magnetic Field Lines run parallel to the wellbore conduit Axis 56. The windings are helically-wound in the azimuthal direction around the conduit and extend over an axial length L of the body. Additional components of the Magnetorheological Blowout Preventer 51 may include Bolt Flange 55 with circumferentially deployed Bolts 58 for mating to the riser and/or additional blowout preventers in a stack configuration.

Preferably, but not necessarily, there will be multiple solenoid windings used at the same time and placed in magnetic opposition to each other (or not) to increase the strength of the magnetic field inside the conduit thereby increasing the pressure holding capacity of the plug.

In this particular embodiment, the Core of the Electromagnet is comprised of Magnetorheological Drilling Fluid contained in the Drill String 57 and/or the annular volume between the inner surface of the Conduit 59 and the outer surface of the Drill String 57. When the electromagnets are engaged (that is, when current is passed through the Electrically Conductive Windings), the Magnetic Field produced by the Electromagnet(s) will cause the magnetorheological drilling fluid to form an extended plug 54 over length L for purposes of terminating the flow of oil and/or natural gas effluent 63 along the wellbore conduit.

Preferably, but not necessarily, the bore inside the Magnetorheological Blowout Preventer 51 has been funneled down (that is, decreased in transverse cross-sectional extent) to increase the magnetic field strength in the plug region.

One group of embodiments of the present invention involves the use of Ferrofluids. Unlike Magnetorheological Fluids, Ferrofluids remain in the liquid state in the presence of a magnetic field, but Ferrofluids do stop or slow in their movement under the influence of a magnetic field. In the present invention, this can be used to great advantage for keeping the natural gas and/or petroleum effluent at bay while the drilling string continues to rotate. More specifically, if the plug formed by magnetic action of the present invention is at least substantially in the liquid state, then the drill string can continue to rotate freely, which is preferred. Furthermore, it is generally preferred that the drill string be able to rotate with as little friction as possible. This means that when the plug of the present invention (or at least the part of the plug that surrounds the drill string) is made of relatively low viscosity liquid (such as an activated FerroFluid) the plug will not frictionally interfere with the rotating operation of the drill string.

It is possible to convert a Ferrofluid into an inverse (composite) Magnetorheological Fluid by simply adding the necessary non-magnetic, surfactant-coated particles of sufficient size and quantity. In this way, the liquid plug can be readily converted into a solid plug thereby increasing the pressure holding capacity of the system. In this case, the reservoir could be filled with solid glass beads for instance which might be advantageous for long-term storage. To state this another way, the Ferrofluid is a magnetic (and magnetically pluggable) fluid that stops or slows to help form a plug (or other conduit sealing formation). The non-magnetic particles serve as a form of mechanical blockage that works with in conjunction to also help form the plug (or other conduit sealing formation). This can be contrasted with flow prevention systems 6 and 8, discussed above in conjunction with FIGS. 8 and 12 respectively, where a large scale core members, acting as rams, provided mechanical blockage to help form a plug in conjunction with magnetic action of a fluid. Not all embodiments of the present invention will necessarily use both movable mechanical blockage, and magnetically induced blockage, working co-operatively, but in embodiments where both forms of blockage are present, the mechanical blockage portion of the plug can take many, many different forms, geometries and ways of being moved into the space of the Kill Zone.

Discussion of Some General Principles

Some general principles that are believed to underlie certain embodiments of the present invention will now be discussed. It should be understood that this discussion is presented not to limit the present invention as set forth in the claims, but, rather, to try to help others make and use well-designed embodiments of the present invention. In the various principles that govern fluid flow along a conduit, including but not limited to Pascal's Principle, Archimedes Principle, Bernoulli's Principle, Venturi's Effect and Poiseuille's Law, there may be certain novel advantages that can be brought about by incorporating a magnetorheological fluid whose viscosity can be magnetically controlled to inhibit or stop the flow of effluents (petroleum oil and/or natural gas) along a conduit. Preferably, but not necessarily, these advantages would come about as a result of using one or more electromagnets outside of the wellbore conduit to change the viscosity of the magnetorheological fluid and thereby impart a change in the effluent flowing along the conduit.

Whatever the specific embodiment may be, Blowout Preventers conforming to the present invention encompass any type of construction that utilize a magnetic fluid (ferrofluid, magnetorheological fluid and/or inverse magnetorheological fluid) in any of its construction to facilitate control over the flow of effluent using one or more permanent magnets and/or electromagnets.

Fundamental to the understanding of magnetorheological fluids is the general behavior of magnetic materials.

The magnetic properties of a material are imbued in the constitutive relations: $B=\mu H$ and $M=\chi_m H$ where B is the vector of magnetic induction or magnetic flux density (in Tesla), H is the vector of applied magnetic field (in Amps/meter), M is the vector of magnetization (in Amps/meter), $\mu$ is the permeability (in Henrys/meter) and $\chi_m$ is the magnetic susceptibility (unitless).

When a magnetic field H is applied to a magnetic material, the material responds by producing a magnetization M whereby $B=\mu_0(H+M)$ such that $\mu=\mu_0(1+\chi_m)$ with $\mu_0=47\times10^{-7}$ kg-m/C$^2$ (that is, the permeability of free space).

Materials with a magnetic susceptibility $\chi_m>0$ are called paramagnetic in that their presence causes a strengthening of the magnetic induction relative to the applied magnetic field.

In paramagnetic materials, each atom has a magnetic moment that is randomly oriented as a result of thermal motion. Examples of paramagnetic materials include Aluminum: Al ($\chi_m=+16.5\times10^{-6}$) and Titanium: Ti ($\chi_m=+151\times10^{-6}$).

Materials with a magnetic susceptibility $\chi_m<0$ are called diamagnetic in that their presence causes a weakening of the magnetic induction relative to the applied magnetic field. In diamagnetic materials, each atom has zero magnetic moment. Examples of diamagnetic materials include Gold: Au ($\chi_m=-28\times10^{-6}$), Copper: Cu ($\chi_m=-5.46\times10^{-6}$), and Bismuth: Bi ($\chi_m=-280.1\times10^{-6}$).

For most paramagnetic and diamagnetic materials, the magnetic susceptibility is very small $|\chi_m|<<1$. Equivalently, the relative permeability defined as $\mu_r=\mu/\mu_0=(1+\chi_m)$ is very nearly equal to unity (that is, $\mu\approx\mu_0$) for most paramagnetic and diamagnetic materials.

As used herein and throughout, the term "non-magnetic particles" shall refer to those particles that are comprised of paramagnetic or diamagnetic materials.

Ferromagnetic materials exhibit non-linear, hysteretic behavior between the magnetic induction and the applied magnetic field, such that $B=\mu(H)H$ where $\mu=\mu(H)$ is field dependent and <<1. Ferromagnetic materials have their atoms arranged in a lattice with their magnetic moments aligned parallel to each other. In the periodic table of elements, only Iron (Fe), Cobalt (Co) and Nickel (Ni) are ferromagnetic at room temperature. As used herein and throughout, the term "magnetic particles" or "magnetizable particles" shall refer to those particles that are comprised of ferromagnetic, antiferromagnetic and/or ferrimagnetic substances.

Let us consider how the magnetic induction B=|B| changes as a function of the applied magnetic field H=|H| in a never-before-magnetized sample of ferromagnetic material (that is, the so-called induction curve or "hysteresis" loop).

Figure 11:
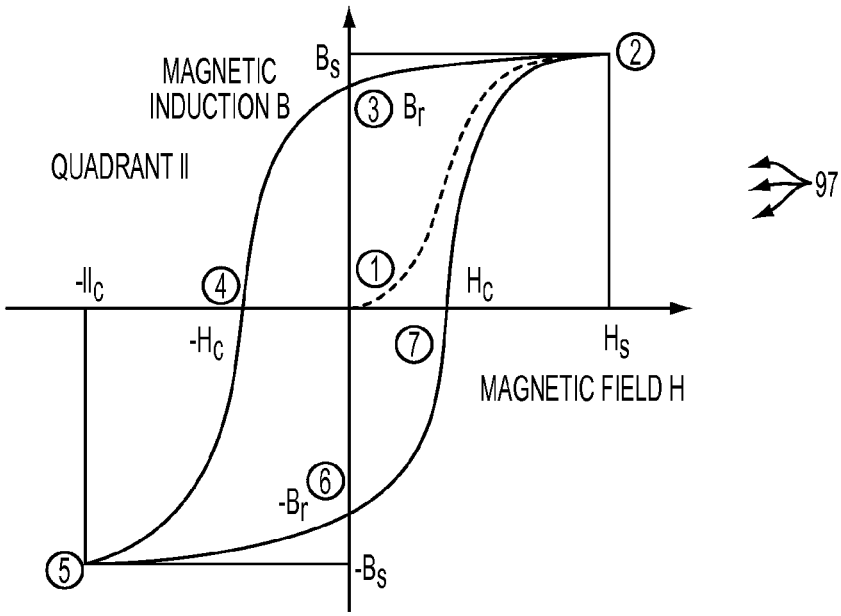
FIG. 11 is a graph helpful in explaining certain principles used in the present invention.

Referring to graph 97 of FIG. 11, as H is first increased from zero (point 1, along the dashed line), there are only small increases in B, during which time there is a stretching of magnetic domain boundaries in the material. As H is further increased, B begins to increase more and more rapidly, until small increases in H bring about large increases in B. In this region, magnetic domains grow in the direction of H. As H is further increased, increases in B begin to slow down. Increasing H beyond a saturating value $H_s$ causes no further increases in B beyond its saturation value $B_s$ (point 2). After reaching saturation, if the magnetic field H is reduced in magnitude back down to zero, we find interestingly that the magnetic induction B does not follow along the initial B-H curve. Instead, it follows a new curve with a Residual Induction $B_r$ occurring at H=0 (point 3). The residual induction $B_r$ is often used to differentiate between so-called "hard" magnetic materials and "soft" magnetic materials. Hard magnetic materials typically have a large residual induction as compared to soft magnetic materials.

If we now reverse the direction of the applied magnetic field H (that is, we allow the magnetic field to take on negative values), the magnetic induction B will continue to decrease until it reaches a value of zero at $H=-H_c$ (point 4) where $H_s$ is called the Normal Coercive Force. Increasing the applied magnetic field further (in the reverse direction) will cause the magnetic induction to take on negative values. Eventually, the magnetic induction will saturate again (point 5), at which time further negative increases in H will bring about no further changes in B. As H is again reduced in magnitude towards zero, the magnetic induction will reach its residual value $-B_r$ (point 6). And finally, as the magnetic field H increases from zero, in the forward direction, the magnetic induction B will pass through zero at $H=+H_c$ (point 7), and continue on to B=Bs at H=Hs (point 2) thereby closing the hysteresis loop.

For characterizing magnetic materials, traditionally, the complete hysteresis loop is seldom used. More often than not, only quadrant II of the complete induction curve is given, along with H. Quadrant II of the hysteresis loop is typically called the "demagnetization curve."

"Hard" magnetic materials have a high resistance to demagnetization and "Soft" magnetic materials are easily demagnetized. As a result, hard magnetic materials are the basis for permanent magnets and soft magnetic materials are used in the core of electromagnets.

Some embodiments of the present invention may employ one or more permanent magnets. Magnetic properties of a permanent magnet typically include: Residual Induction $B_r$, Normal Coercive Force $H_s$ and maximum Energy Product $BH_{max}$. $BH_{max}$ is simply the largest product of B and H along the demagnetization curve. This corresponds to that point on the curve which yields the largest area for any enclosed rectangle in Quadrant II of the hysteresis loop. The maximum Energy Product $BH_{max}$ is a measure of the ability of a permanent magnet to do work per unit volume of material. Other important properties of a permanent magnet include: shape, size (dimensions), pole shape and number of poles, magnetization direction, weight, operating temperature, resistance to oxidation, surface coatings and their ability to survive a sudden impact load without crumbling or being demagnetized.

Preferably, but not necessarily, materials to be used in the fabrication of permanent magnets to be included in a Magnetorheological Blowout Preventer include Fe, Co, Ni, BaO:$Fe_2O_3$, SrO:$Fe_2O_3$, MnO:$Fe_2O_3$ and/or combinations thereof.

More preferably, but not necessarily, materials to be used in the fabrication of permanent magnets to be included in a Magnetorheological Blowout Preventer include: $Nd_2Fe_{14}B$, $Sm_2Fe_{17}N_3$, $Sm_2CO_{17}$, $SmCO_5$, $BaFe_{12}O_{19}$ and/or combinations thereof.

Permanent magnets of various types are commercially available from Master Magnetics (Castle Rock, Colo. (USA)), AMF Magnetics (Mascot, NSW (Australia)) and Eclipse Magnetics (Sheffield, England).

Some embodiments of the present invention employ one or more electromagnets. The magnitude of the magnetic induction produced by an electromagnet is given by the relation B=μnl where μ is the magnetic permeability of the core, n is the number of individual wire turns surrounding the core and l is the electric current traversing the wire.

Electromagnets are quantitatively characterized by a number of different design parameters including but not limited to their: Magnetic Field Strength in Tesla, Core (aka Yoke) Material and Design (including its dimensions, laminations, etc), Electrically Conductive Windings (including their material, dimensions, cross section, winding geometry and the number of windings or plates), Insulating Materials (both wire and layer-to-layer), Bobbin Material and Design, Electrical Requirements (Current and Voltage DC or AC Operation, Duty Cycle, Continuous or Pulsed Operation, Electrical Connections, etc), Shape and Number of Magnetic Poles, Lifting Capacity, Thermal Management (Coolants such as Deionized Water. Cryogens such as Liquid Helium and Liquid Nitrogen, Coolant Flowrates, Velocity, Pressure, etc), Overall Size (i.e. Footprint), Overall Weight, Encapsulation Materials (i.e. epoxy), Supporting Frame, Hydraulic Connections, Magnetic Field Lines and their rate of excitation/decay as the electric current is turned on/off, among other things.

The Core or Yoke of an electromagnet (if any) can be made from a number of different materials including iron and steel. Today, most electromagnet cores are made from steel (that is, iron with controlled amounts of carbon contained therein). The magnetic properties of steel vary greatly depending on their chemical composition, mechanical processing and thermal processing. Usually, the magnetic performance of steel is dominated by its carbon content. A very common grade of magnet steel is 1010 steel with a carbon content of ≤0.10%.

Over the years, the strength of an electromagnet (measured in Tesla) has risen steadily. The Tesla is an SI (Systeme International) unit of magnetic induction B (also referred to as the magnetic flux density). In SI units, the Tesla is equivalent to a (Newton-Second)/(Coulomb-Meter). Alternatively, one Tesla is equal to 10,000 Gauss.

To put magnetic field strength into perspective, the earth's magnetic field is nominally 0.5 Gauss (or 50 uT) and an ordinary "refrigerator" magnet might be on the order of 10 Gauss (or 1 mT). And, the strength of a Magnetic Resonance Imaging (MRI) system might be on the order of 2 Tesla whereas the Guinness World Record for a continuous field electromagnet is 45 Tesla at the National High Magnetic Field Laboratory (NHMFL) in Tallahassee, Fla. Nowadays, cryogen-free, superconducting electromagnets with turn-key operation are available up to 20T.

There are two basic classes of electromagnets: Continuous and Pulsed. Pulsed electromagnets circumvent the challenges of resistive (aka Joule) heating by producing a magnetic field for only a short duration of time (on the order of 10 ms). Continuous electromagnets produce a magnetic field for as long as the electrical current flows along its windings. Of these two, clearly the continuous electromagnet is better suited for use in a Magnetorheological Blowout Preventer (MRBOP). Within these two classes, electromagnets can be further subdivided into Resistive, Superconducting and Hybrid types.

Resistive electromagnets include both dissipative windings surrounding a ferromagnetic core and dissipative windings surrounding an air core (as in the case of the simple solenoid). Superconducting electromagnets utilize composite wires with type II superconducting filaments (such as NbTi or $Nb_3Sn$) immersed in a copper matrix. These filamentary composite wires, when cooled to Liquid Helium temperatures (4.2K), exhibit near-zero resistance.

A Magnetorheological Blowout Preventer according to the present invention would likely benefit from future advances made in High Temperature Superconductors wherein the cooling requirements of a Superconducting electromagnet are relaxed to Liquid Nitrogen temperatures (77K) and well above.

As used herein and throughout, the term Core shall refer to the volume of space found within the electrically conductive windings.

Preferably, but not necessarily, the Core Material will be comprised of soft iron, wrought iron, cast iron, cast steel, rolled steel, 1010 steel, magnetic fluid or air (as in the case of a simple solenoid).

As used herein and throughout, the terms "Electrically Conductive Windings" or "Windings" or "Electrically Conductive Conduit" shall be equivalently and colloquially referred to as a "wire" used for the purpose of generating a magnetic field when an electric current passes therethrough.

The windings used in electromagnets in embodiments of the present invention may be any type of current carrier (now known or to be developed in the future). These windings can take on virtually any shape. For example in a Bitter electromagnet assembly (see "Water Cooled Magnets", Review of Scientific Instruments, Vol. 33, No. 3, p. 342, 1962), broad, performated, round conductive plates are interleaved with insulator plates and stacked to form a thick monolayer winding. Such an assembly is commonly used in very powerful electromagnets and would be amenable for use in a Magnetorheological Blowout Preventer.

Some embodiments of the present invention may include Wire Insulation. Wire Insulation may be comprised of silk, varnish, polyimide, PVA, baked-on plastic (Formvar or Polythermaleze), glass fiber, Mylar tape, Kapton tape, Dacron tape and/or woven tape. Preferably, but not necessarily, the Layer-to-Layer Insulation will be comprised of varnished paper, glass cloth, vulcanized rubber, thin layers of mica and/or ebonite.

As used herein and throughout, the term "Bobbin" or "Former" or "Mandrel" shall refer equivalently to a cylindrical member around which the Conductive Wire and Cooling Conduit are wound.

Preferably, but not necessarily, the Bobbin (aka Former or Mandrel) will be comprised of steel, aluminum, brass, copper, cotton-filled epoxy, glass-filled epoxy or a machinable glass-ceramic such as Macor.

As used herein and throughout, the term "Solenoid" shall refer to a juxtaposition of wire loops wound into a helical shape with only air at its center.

EXAMPLES

The invention described herein is not meant to be limited in scope by the specific examples disclosed herein. These examples are intended to be illustrative of the invention only and not wholly encompassing of it.

Example 1

A Magnetorheological Blowout Preventer according to the present invention may possibly consist of a Housing with two Magnetic Ram Assemblies circumferentially fastened at 180 degrees thereto and Bolt Flanges for mounting onto a riser, wherein each of said Magnetic Ram Assemblies is further comprised of a powerful Electromagnet with a Magnetic Piston/Core that translates into and out of the flow stream as necessary, wherein Pole Face of said Core is proximal to a Magnetorheological Fluid released into the effluent stream from a reservoir, wherein magnetic field emanating from Pole Face causes the Magnetorheological Fluid nearby to congeal into a solid Plug capable of sealing off any arbitrary volume as a Magnetorehological Ram Head for purposes of terminating the flow of natural gas and/or petroleum effluent along a wellbore conduit.

Example 2

A Magnetorheological Blowout Preventer according to the present invention may possibly consist of a Housing with four Magnetic Ram Assemblies circumferentially fastened at 90 degrees thereto in a Quadrupole configuration and Bolt Flanges for mounting onto a riser, each of said Magnetic Ram Assemblies is further comprised of a powerful Electromagnet with a Magnetic Piston/Core that translates into and out of the flow stream as necessary, wherein Pole Face of said Core is proximal to a Magnetorheological Fluid released into the effluent stream from a reservoir, wherein magnetic field emanating from Quadrupole Faces cause the Magnetorheological Fluid nearby to form an annular plug between the inner surface of the riser and the outer surface of the drill string for purposes of differentially controlling the passage of magnetic drilling fluid, natural gas and/or petroleum effluent along a wellbore conduit.

Example 3

A Magnetorheological Blowout Preventer according to the present invention may possibly consist of a Housing with one or more annular-shaped Solenoid Grating Arrays fastened therein and Bolt Flanges for mounting onto a riser, wherein each annular-spaced Solenoid Grating Array is comprised of a grid of independently-controlled solenoid windings with an inner diameter that is large enough to pass petroleum oil, natural gas and/or drill cuttings but small enough to form a solid plug upon electrical excitation when magnetorheological fluid released into the effluent stream from a reservoir is proximal to said solenoids for purposes of reducing or terminating the flow of natural gas and/or petroleum effluent along a wellbore conduit.

Example 4

A Magnetorheological Blowout Preventer according to the present invention may possibly consist of a Housing with one or more helical windings surrounding the housing in a solenoid-like configuration so that magnetorheological fluid released into the effluent stream from a reservoir causes an extended solid plug to be formed for purposes of terminating the flow of natural gas and/or petroleum effluent along a wellbore conduit.

The preferred embodiments and examples disclosed in the foregoing specification are used therein as vehicles of description, and not of limitation. There is no intention, in the use of such embodiments and examples to exclude any equivalents of the features shown and described, or portions thereof. It is appreciated that numerous modifications and/or embellishments to these embodiments and examples may be devised by those who are skilled in the art.

DEFINITIONS

Any and all published documents mentioned herein shall be considered to be incorporated by reference, in their respective entireties. The following definitions are provided for claim construction purposes:

Present invention: means "at least some embodiments of the present invention," and the use of the term "present invention" in connection with some feature described herein shall not mean that all claimed embodiments (see DEFINITIONS section) include the referenced feature(s).

Embodiment: a machine, manufacture, system, method, process and/or composition that may (not must) be within the scope of a present or future patent claim of this patent document; often, an "embodiment" will be within the scope of at least some of the originally filed claims and will also end up being within the scope of at least some of the claims as issued (after the claims have been developed through the process of patent prosecution), but this is not necessarily always the case; for example, an "embodiment" might be covered by neither the originally filed claims, nor the claims as issued, despite the description of the "embodiment" as an "embodiment."

First, second, third, etc. ("ordinals"): Unless otherwise noted, ordinals only serve to distinguish or identify (e.g., various members of a group); the mere use of ordinals shall not be taken to necessarily imply order (for example, time order, space order, or order of importance).

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connections that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

magnetically pluggable fluid: a fluid that can form (at least a portion of) a plug in response to application of a magnetic field; there at least are three distinct modes under which a magnetically pluggable fluid may form (at least a portion of) a plug as follows: (i) viscosity mode wherein the viscosity of the fluid increases in response to a magnetic field to form (at least a portion of) a plug, (ii) inertial mode where the motion of the fluid slows or stops in response to the magnetic field to form (at least a portion of) a plug, and/or (iii) particle extraction mode where particles suspended in the fluid are pulled out of suspension in response to a magnetic field to form (at least a portion of) a plug; a single magnetically pluggable fluid may exhibit more than one of these three modes in forming (at least a portion of) a plug; in some embodiments a "plug" (see DEFINITIONS section) may be formed solely by the magnetic response of the magnetically pluggable fluid, while in other embodiments the plug may be formed in part by traditional mechanical blockage and/or chemicals (for example, hardening agents) aided by the magnetic action of the magnetically pluggable fluid; while many "magnetic fluids" will also be "magnetically pluggable fluids," these two categories of matter, as defined herein, are not necessarily co-extensive in all respects.

conduit sealing formation: a plug and/or patch structure.

semi-solid plug: includes solid plugs and/or semisolid plugs.

plug: any liquid and/or solid structure that will significantly decrease the rate of fluid flow through the interior space of a well-conduit conduit, although it is not necessarily required that all passage of the fluid be completely stopped; in the context of a plug in an oil well conduit, the plug must slow the flow of oil and/or natural gas effluent so that damage caused by any remaining flow is at least substantially mitigated as compared to the amount of damage there would be without the plug.

magnet: any object and/or device (now known or to be developed in the future) that creates a magnetic field, regardless of its theory of operation.

wellbore conduit: any conduit in fluid communication with a fluid drilling wellbore, including any conduit portion that may be inserted into the wellbore itself; wellbore conduit often extends into the Earth down to solid rock, and will often extend up out of the wellbore into the sea and/or into the air; many wellbore conduits will be part of oil wells for pumping oil bearing fluid and/or natural gas out of the Earth for use as fuel, but the term "wellbore conduit" is not necessarily so limited; many wellbore conduits will have a drill string disposed in their interior space, but this is not necessarily required; many wellbore conduits have an interior space with a circular cross section, but this is not necessarily required; many wellbore conduits run vertically, but this is not necessarily required; as used herein, a "wellbore conduit portion" may refer to a part of the wellbore conduit that is under the sea or even under the surface of the Earth (which is where a patch according to the present invention may be applied in or on the lateral wall of the wellbore conduit), or it may refer to a part of the wellbore conduit where BOPs are typically located (which is where a plug is more likely to be applied according to the present invention).

Unless otherwise explicitly provided in the claim language, steps in method or process claims need only be performed that they happen to be set forth in the claim only to the extent that impossibility or extreme feasibility problems dictate that the recited step order be used. This broad interpretation with respect to step order is to be used regardless of alternative time ordering (that is, time ordering of the claimed steps that is different than the order of recitation in the claim) is particularly mentioned or discussed in this document. Any step order discussed in the above specification, and/or based upon order of step recitation in a claim, shall be considered as required by a method claim only if: (i) the step order is explicitly set forth in the words of the method claim itself; and/or (ii) it would be substantially impossible to perform the method in a different order. Unless otherwise specified in the method claims themselves, steps may be performed simultaneously or in any sort of temporally overlapping manner.

Also, when any sort of time ordering is explicitly set forth in a method claim, the time ordering claim language shall not be taken as an implicit limitation on whether claimed steps are immediately consecutive in time, or as an implicit limitation against intervening steps.

I claim:

1. A blowout preventer, comprising:

a wellbore conduit portion;

a magnet set including at least one magnet; and a magnetic fluid comprising a suspension of magnetic and/or magnetizable particles in a carrier liquid, wherein the magnetic fluid is selected from the group consisting of: a ferrofluid, a magnetorheological fluid, an inverse magnetorheological fluid, and/or combinations thereof, further wherein the wellbore conduit portion is connectable into fluid communication with a wellbore conduit, the wellbore conduit portion and the magnet set are sized, shaped, connected, structured and/or located so that a conduit sealing formation will form in the conduit portion when the following two conditions are met:

(i) the magnet set is configured to generate a magnetic field, and (ii) the magnetic fluid is caused to flow in the wellbore conduit portion.

2. The blowout preventer of claim 1, wherein the magnetic and/or magnetizable particles comprise at least one of the following: ferromagnetic, anti-ferromagnetic or ferrimagnetic substances.

3. The blowout preventer of claim 2, wherein the ferromagnetic, anti-ferromagnetic or ferrimagnetic substances comprise at least one of the following: iron, cobalt, nickel, magnetite, maghemite, cobalt ferrite, manganese ferrite, carbonyl iron, iron-filings, iron filings and/or iron-powder.

4. The blowout preventer of claim 1, wherein the carrier liquid includes at least one of the following: water, animal oil, mineral oil, vegetable oil, synthetic oil, petroleum oil, petroleum distillates, alcohol, glycol, glycerin, glucose, diester, paraffin, carbon tetrafluoride and/or combinations thereof.

5. The blowout preventer according to claim 1, wherein the carrier liquid further comprises at least one of the following: an anti-oxidizing agent, anti-corrosion agent, anti-wear agent, anti-agglomeration agent, surfactant and/or anti-settling agent.

6. The blowout preventer according to claim 1, wherein the carrier liquid further comprises a curing agent that hardens to form a permanent plug.

7. The blowout preventer according to claim 1, wherein the magnetic fluid is comprised of a colloidal suspension of surfactant-coated, nanometer-sized, single-domain, magnetic particles immersed in a carrier liquid.

8. The blowout preventer according to claim 7, wherein the magnetic particles have a diameter in the range of about 3 nanometers to about 15 nanometers.

9. The blowout preventer according to claim 1, wherein the magnetic fluid is comprised of a non-colloidal suspension of surfactant-coated, micrometer-sized, multi-domain, magnetizable particles immersed in a carrier liquid.

10. The blowout preventer according to claim 9, wherein the magnetizable particles have a diameter in the range of about 1 um to about 10 um.

11. The blowout preventer according to claim 1, wherein the magnetic fluid is comprised of a composite suspension of surfactant-coated, micrometer-sized, non-magnetic particles and nanometer-sized magnetic particles both immersed in the same carrier liquid.

12. The blowout preventer according to claim 1, wherein the magnet set is structured and/or located so that the conduit sealing formation includes a plug.

13. The blowout preventer according to claim 1, wherein the magnet set is structured and/or located so that the conduit sealing formation includes a patch.

* * * * *